United States Patent [19]

Lewis

[11] 4,395,901

[45] Aug. 2, 1983

[54] RUNNING STOP

[76] Inventor: Paul E. Lewis, R.R. 3, Box 210, Rochester, Ind. 46975

[21] Appl. No.: 291,227

[22] Filed: Aug. 10, 1981

[51] Int. Cl.[3] ..... B21D 11/22; B21D 43/26

[52] U.S. Cl. ..... 72/461; 72/36

[58] Field of Search ..... 72/389, 461, 386, 36; 269/317, 316

[56] References Cited

U.S. PATENT DOCUMENTS

| | | | |
|---|---|---|---|
| 784,726 | 3/1905 | Yates | 72/461 |
| 2,685,824 | 8/1954 | Coop | 269/317 |
| 2,769,493 | 11/1956 | Karsoe | 269/317 |
| 3,421,359 | 1/1969 | Gibbs | 72/461 |
| 3,740,996 | 6/1973 | Hix | 72/461 |
| 3,812,695 | 5/1974 | Roch | 72/461 |
| 3,826,119 | 7/1974 | Marotto | 72/461 |
| 4,055,070 | 10/1977 | Wingate | 72/461 |
| 4,089,200 | 5/1978 | Wingate | 72/389 |

*Primary Examiner*—Gene Crosby

*Attorney, Agent, or Firm*—Barnes & Thornburg

[57] ABSTRACT

A stop is disclosed for stopping a workpiece at a desired location relative to a work station. The stop includes a holder having a slot in an edge thereof, the axis of the slot being oriented substantially out of the plane of approach of a workpiece. A ball is linearly movably retained in the slot so as to partially project beyond the edge of the holder. A biasing spring biases the ball toward an end of the slot for contact with the workpiece.

20 Claims, 5 Drawing Figures

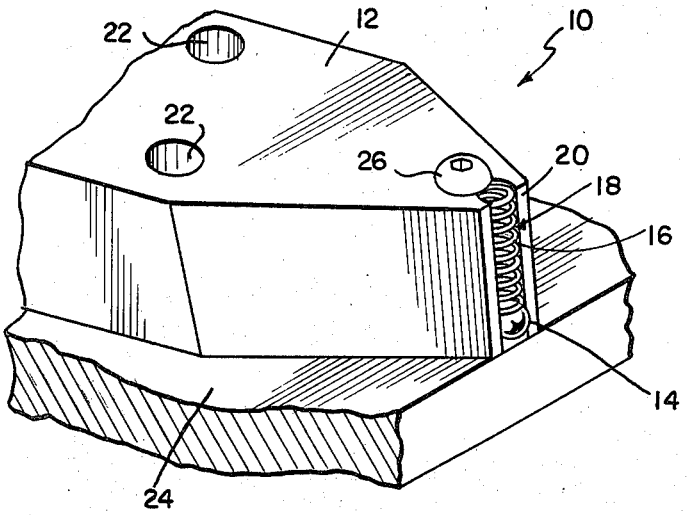
FIG. 1
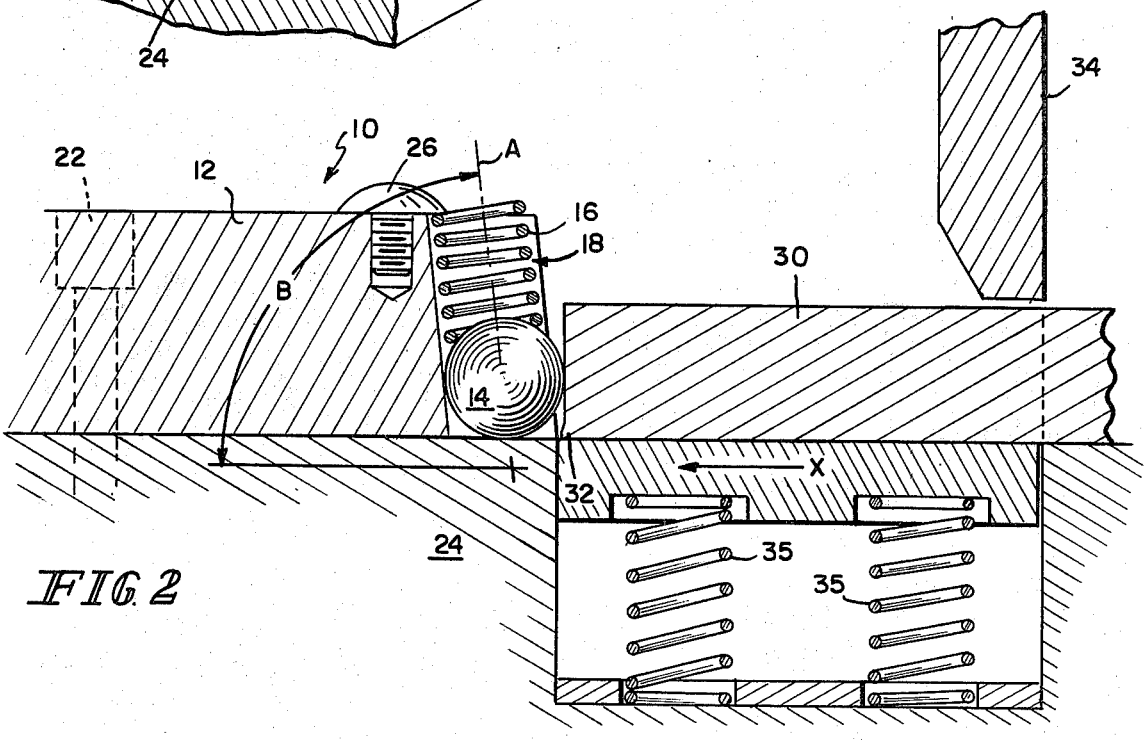
FIG. 2
FIG. 3
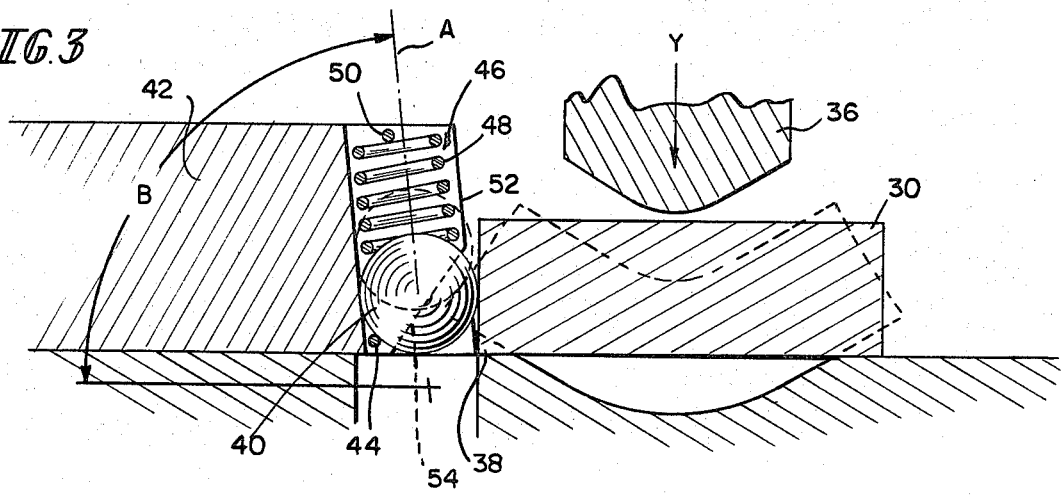

RUNNING STOP

This invention relates generally to work holders typically employed in metal-deforming apparatus, and more particularly to work-stopping abutments which include a resiliently urged or biased element which is displaceable in a direction substantially vertical to the plane of the workpiece being stopped by the abutment. Prior art devices of this general type can be found in the classified collection of the United States Patent and Trademark Office in Class 72/Subclass 461 and in Class 269/Subclasses 316 and 317.

Typical work-stopping abutments of the prior art consist of a support which is usually adjustably mountable with respect to a work station where a metal-deforming operation such as cutting or bending takes place. A bar or gauge pivotally mounted with respect to the support extends outwardly therefrom to define a workpiece abutment against which the workpiece is positioned immediately prior to the appropriate metal-deforming operation. The pivotal connection between the bar or gauge and the support is provided so that the gauge or bar is free to move with respect to the workpiece as the workpiece experiences the metal-deforming operation. A biasing means is often included biasing the gauge bar with respect to the support in such a manner as to cause the gauge bar to return to the preset position following each metal-deforming operation so as to be in position for the subsequent positioning of the next workpiece against the work-stopping abutment. Examples of prior art devices of this type are to be found in U.S. Pat. Nos. 784,726; 2,769,493; 3,421,359; 3,812,695; and 4,089,200.

Work-stopping abutment devices of the type previously described suffer at least two disadvantages. First, during repeated use, the workpiece may be caused to abut the gauge or bar of the work-stopping abutment with a force sufficient that over a period of time the pivot axis between the gauge or bar and the support can become deformed, thereby requiring that the position of the support be adjusted with respect to the work station. Secondly, where the bar or gauge is pivoted with respect to the support about a single point, the motion of the bar or gauge during the metal-deforming operation is necessarily tangent to the work-abutting surface. A withdrawal of the gauge or bar along a line other than a tangent line to the gauged surface of the workpiece can be achieved by providing a variable pivot position as taught by Karsoe U.S. Pat. No. 2,769,493, but such stop mechanisms are unnecessarily complicated and have not met with wide commercial success.

In order to overcome the disadvantages of the prior art, the present invention employs a holder having a slot in an edge thereof, the axis of the slot being positioned substantially out of the plane of approach of a workpiece. A ball is linearly movably retained in the slot so as to partially project beyond the edge of the holder. A biasing means is provided for biasing the ball toward an end of the slot for contact with the workpiece. The axis of the slot with respect to the approach plane of the workpiece is generally a large acute angle at the holder typically between about 80° and 90° and preferably about 85°. The surface of the ball itself provides the gauge against which the workpiece is positioned. During the subsequent metal-deforming step, the ball is free to both roll and linearly be displaced against the biasing means so as to permit a free, non-binding displacement of the workpiece with respect to the work station during the deforming operation. The displaceability of the ball through the large angle defined by the axis of the slot with respect to the plane of approach of the workpiece provides both the necessary gauging function and the necessary work-releasing function intended by resiliently urged work-stopping abutments of this general type.

The various features and advantages of the present invention will be appreciated by those having skill in the art by considering the accompanying drawings illustrative of the invention and showing preferred embodiments exemplifying the best mode of carrying out the invention as presently preceived. In such drawings:

FIG. 1 is a perspective view of a stop according to the present invention;

FIG. 2 is a sectional view of the stop shown in FIG. 1 and its relationship to a workpiece;

FIG. 3 is a sectional view of another embodiment of the present invention as it may be employed in a forming operation;

Figure 4:
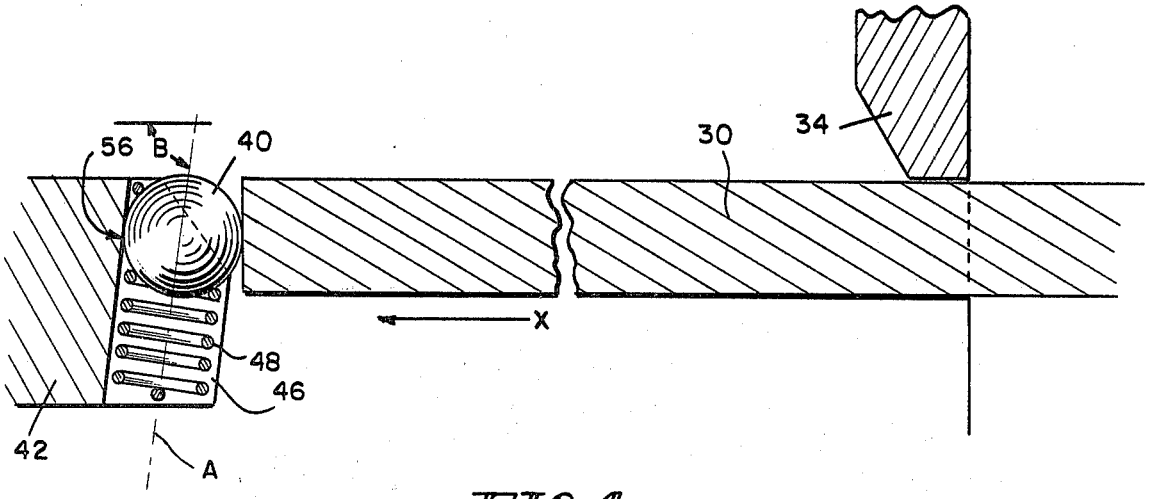
FIG. 4 is a sectional view of the stop shown in FIG. 3 as it might be employed in another metal-deforming operation.

A stop 10 according to the present invention is shown in FIG. 1 to comprise a holder 12 holding a ball 14. The holder 12 functions to retain the ball, while a spring 16 yieldably urges the ball 14 toward a projected use position. The holder or retaining means 12 includes an opening or slot 18 in which the ball linearly moves. The slot is preferably included on a projected edge 20 of holder 12. The holder 12 can include appropriate locating means such as pins 22 for fixing the holder relative to a base 24 adjacent a work station. In the stop shown in FIG. 1, the spring-biasing means 16 is fixed to holder 12 by fastener 26.

As can be seen in FIG. 2, the axis A of slot 18 is at a large acute angle B in the holder 12 with respect to the direction of approach X of workpiece 30. The force applied to ball 14 by the workpiece 30 as it initially contacts stop 10 is substantially horizontal as shown in FIG. 2. The contact area of the ball 14 with respect to workpiece 30 is very small, thereby eliminating errors which might ordinarily occur due to the presence of burs or tangs 32 created on the workpiece by the incomplete penetration of a cutter 34 or other similar workpiece. During the working operation, the ball 14 is free to both rotate and move linearly along axis A within slot 18, but is constrained by biasing means 16 to only move as far as is necessary to permit the workpiece 30 to become appropriately displaced by the working action of the working element 34 and by the return action of the spring pressure pad 35.

In the alternative embodiment illustrated in FIG. 3, a ball 40 is yieldably retained in a retaining means 42 by a plug means 44 such as a wire or screw traversing a portion of the slot 46 in the retaining means 42. The spring-biasing means 48 in slot 46 is further retained in position by a fastener means 50. The edge 52 of retaining means 42 includes a chamfered section 54 which provides an enlarged opening at the end of slot 46 to which ball 40 is biased by the spring 48. The stop in FIG. 3 is shown to be included in a form-punching operation wherein the workpiece 30 is deformed by punch 36 descending in direction Y and causing a corner 38 of workpiece 30 to force ball 40 upwardly along the axis A of slot 46. As punch 36 is removed from contact with the workpiece 30, the spring 48 acting on ball 40 causes the ball 40 to return to its initial position, after the formed workpiece is removed from the work station.

The alternative embodiment of the stop shown in FIG. 3 is shown also in FIG. 4 in an inverted position to emphasize that the direction of motion of the ball 40 with respect to the work station is not necessarily upward since the return force operating on the ball is provided by the biasing means 48 and not by gravity. It is important that the axis A of the opening 46 in which ball 40 travels is situated at a large angle with respect to the plane in which the workpiece 30 approaches ball 40. In this way, the force of the workpiece 30 acting on ball 40 is largely resisted by the back surface 56 of opening 46 with only a small force being required to be overcome by the spring 48. This permits the strength of spring 48 to be kept rather small, thereby permitting the required freedom of movement of ball 40 within opening 46 along the axis A during the displacement of the workpiece 30 during the metal-deforming operation by working element 34.

Figure 5:
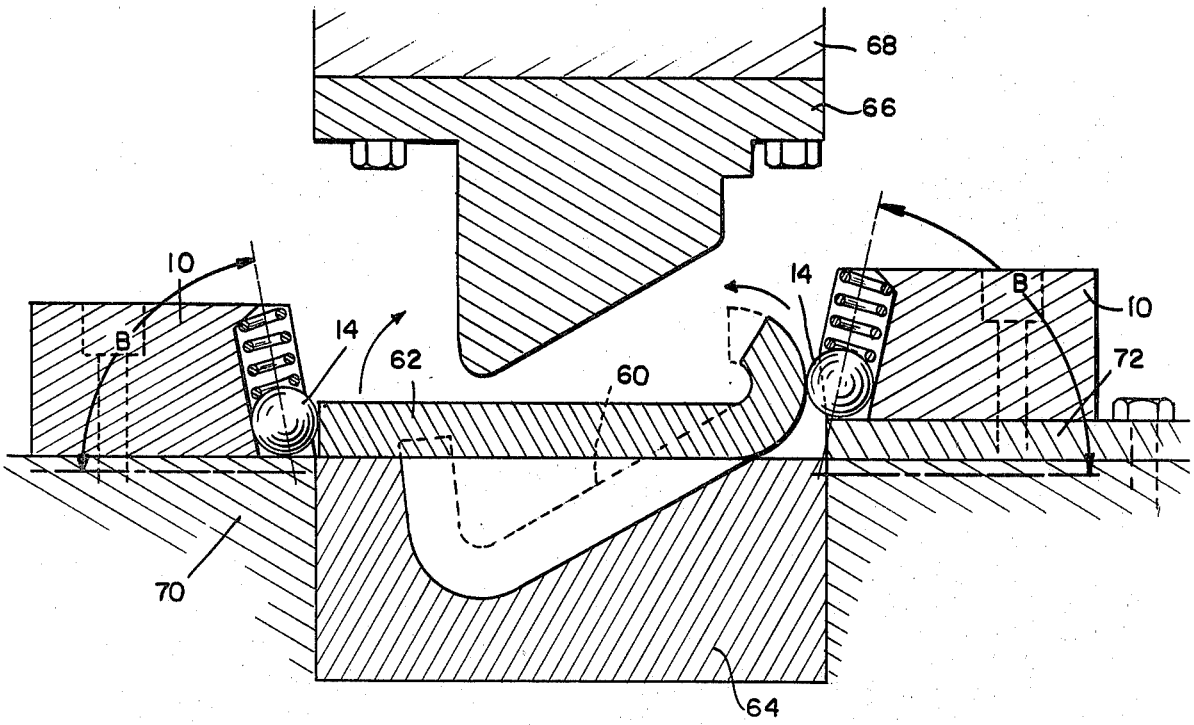
FIG. 5 is a sectional view of a punch-forming operation employing two stops according to the present invention.

In FIG. 5, a punch-forming operation is shown which incorporates two stops 10 according to the present invention. The punch-forming operation is intended to form a C-shaped part 6 (shown in phantom) from a blank 62 which has been previously shaped as shown. The blank 62 is positioned between the two gauge stops 10 over the die 64. As punch 66 fixed to the press ram 68 descends and contacts the blank 62, the ends of the blank move arcuately upward in the direction of the arrows. The spring-biased balls 14 in the stops 10 move linearly against the biasing springs and rotate under the forming action yet maintain sufficient force on the blank 62 as to prevent any undesirable movement of the blank 62 with respect to either the die 64 or punch 66. It is to be noted that at the end of the forming operation, the finished part 60 may still contact the right stop 10, the surface 61 having been arcuately displaced as shown. It should also be noted that the left gauge stop 10 is mounted directly to the die base 70 while the right gauge stop is fixed to a bolster plate 72 which is in turn mounted on the die base 70. Other various uses and deployments of stops 10 according to this invention are believed to be apparent from this disclosure.

While the invention has been described with reference to the presently preferred and illustrated embodiments thereof, it is not intended that the invention be unduly limited by this description of the preferred embodiments, and instead it is intended that the invention be defined by the means and their obvious equivalents set forth in the following claims.

What is claimed is:

1. A stop comprising a ball, means for retaining the ball, and means for yieldably urging the ball toward a projected use position in the retaining means, the retaining means including means providing an opening in which the ball moves along an axis, the axis lying substantially off a line parallel to the force applied to the ball by a workpiece.

2. The stop of claim 1 wherein the axis makes a large acute angle in the retaining means with the line parallel to the force applied by the workpiece.

3. The stop of claim 1 or 2 wherein the angle in the retaining means between the axis and the line parallel to the applied force is between about 80° and about 90°.

4. The stop of claim 3 wherein the angle between the axis and the line parallel to the applied force is about 85°.

5. A stop for stopping a workpiece at a desired location relative to a work station, the stop comprising:

a holder having a slot in an edge thereof, the axis of the slot positioned substantially out of the plane of approach of a workpiece, a ball linearly movably retained in the slot so as to partially project beyond the edge of the holder, and biasing means for biasing the ball toward an end of the slot for contact with the workpiece.

6. The stop of claim 5 further comprising locating means for fixing the holder relative to a work station.

7. The stop of claim 6 wherein the locating means comprises a base upon which the holder is mounted, a surface of the base defining an end of the slot in the holder.

8. The stop of claim 5 further comprising plug means situated at an end of the slot toward which the ball is biased for retaining the ball in the slot.

9. The stop of claim 5 further comprising a chamfer in said edge at the end of said slot toward which the ball is biased for permitting displacement of the ball along the axis of the slot by a workpiece during deformation of that workpiece.

10. In a press comprising a die base, a die held by the die base, a press ram movable with respect to the die base, a punch fixed to the press ram and movable therewith for forming an article from a blank between the die and punch, the improvement comprising at least one gauge stop fixed with respect to the die base, the at least one gauge stop comprising:

a holder having a slot in an edge thereof, the axis of the slot positioned substantially out of the plane of approach of said blank, a ball linearly movably retained in the slot so as to partially project beyond the edge of the holder, and biasing means for biasing the ball toward an end of the slot for contact with the blank.

11. A stop comprising a movable member, means for retaining the movable member for movement between a projecting, workpiece positioning orientation in which it contacts and positions the workpiece and a retracted orientation, and means for yieldably urging the movable member toward the projecting position in the retaining means, the retaining means including means providing an opening in which the movable member moves along an axis between the projecting orientation and the retracted orientation, the axis of the opening lying substantially off a line parallel to the force applied to the movable member by the workpiece.

12. The stop of claim 11 wherein the axis makes a large acute angle in the retaining means with the line parallel to the force applied by the workpiece.

13. The stop of claim 12 wherein the angle between the axis and the line parallel to the applied force is between about 80° and about 90°.

14. The stop of claim 13 wherein the angle between the axis and the line parallel to the applied force is about 85°.

15. A stop for stopping a workpiece at a desired location relative to a work station, the stop comprising:

a holder having a slot in an edge thereof, the axis of the slot positioned in a direction out of the direction of the plane of approach of a workpiece, a member movably retained in the slot so as to partially project beyond the edge of the holder, and means for biasing the movable member toward one end of the slot for contact with the workpiece.

16. The stop of claim 15 further comprising locating means for fixing the holder relative to a work station.

17. The stop of claim 16 wherein the locating means is secured to a base upon which the holder is mounted, a surface of the base defining an end of the slot in the holder.

18. The stop of claim 15 further comprising plug means situated at an end of the slot toward which the movable member is biased for retaining the movable member in the slot.

19. The stop of claim 15 further comprising a chamfer in said edge at the end of said slot toward which the movable member is biased for permitting displacement of the movable member along the axis of the slot by a workpiece during deformation of that workpiece.

20. In a press comprising a die base, a die held by the die base, a press ram movable with respect to the die base, a punch fixed to the press ram and movable therewith for forming an article between the die and punch, the improvement comprising at least one gauge stop fixed with respect to the die base, the at least one gauge stop comprising:

a holder including a passageway which intersects a surface of the holder to form a slot in the surface of the holder, the axis of the passageway positioned in a direction out of the direction of the plane of approach of said article, a member linearly movably retained in the passageway and having a use position in which it partially projects beyond the surface of the holder, and biasing means for biasing the movable member toward the use position for contact with the article to locate it for forming.

* * * * *